US009550642B1

(12) United States Patent
Nishioka

(10) Patent No.: US 9,550,642 B1
(45) Date of Patent: Jan. 24, 2017

(54) SHEET FEEDING DEVICE AND IMAGING FORMING APPARATUS PROVIDED WITH SAME

(71) Applicant: KYOCERA Document Solutions Inc., Osaka-shi, Osaka (JP)

(72) Inventor: Nobuhiro Nishioka, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/194,659

(22) Filed: Jun. 28, 2016

(30) Foreign Application Priority Data

Jul. 27, 2015 (JP) ..... 2015-147529

(51) Int. Cl.

| | |
|---|---|
| ***B65H 3/06*** | (2006.01) |
| ***B65H 1/18*** | (2006.01) |
| ***B65H 5/06*** | (2006.01) |
| ***B65H 1/26*** | (2006.01) |
| ***G03G 15/00*** | (2006.01) |

(52) U.S. Cl.
CPC ..... *B65H 3/0684* (2013.01); *B65H 1/18* (2013.01); *B65H 1/266* (2013.01); *B65H 5/06* (2013.01); *G03G 15/6529* (2013.01); *B65H 2402/31* (2013.01); *B65H 2402/521* (2013.01); *B65H 2402/522* (2013.01); *B65H 2402/61* (2013.01)

(58) Field of Classification Search
CPC ... B65H 3/0607; B65H 3/0676; B65H 3/0684; B65H 2402/31; B65H 2402/521; B65H 2402/522
USPC ..... 271/117, 118
See application file for complete search history.

(56) References Cited

U.S. PATENT DOCUMENTS

2010/0025916 A1* 2/2010 Kusumi ..... B65H 3/047 271/10.06
2012/0193863 A1* 8/2012 Harada ..... B65H 3/0684 271/110
2013/0136517 A1* 5/2013 Hirose ..... B65H 3/0669 399/393
2013/0256971 A1* 10/2013 Ueyama ..... B65H 5/06 271/4.1
2014/0084534 A1* 3/2014 Ichikawa ..... B65H 3/0638 271/109
2015/0321862 A1* 11/2015 Song ..... B65H 3/0684 271/117

(Continued)

FOREIGN PATENT DOCUMENTS

JP 11-322102 11/1999

*Primary Examiner* — David H Bollinger
(74) *Attorney, Agent, or Firm* — Gerald E. Hespos; Michael J. Porco; Matthew T. Hespos

(57) ABSTRACT

A sheet feeding device includes a sheet feeding unit and a feed unit. The sheet feeding unit includes a housing having a pair of wall portions. The feed unit includes a pickup roller and a sheet feed roller. The feed unit includes a holder, a shaft and a pair of bearing portions. The holder has a pair of side walls each having a bearing hole portion. The shaft extends between the pair of side walls. The pair of bearing portions are mounted in the bearing hole portions and rotatably supports the shaft. The housing includes a pair of shaft supporting portions provided on the pair of wall portions and capable of supporting the bearing portions. The feed unit is attached to the housing and the holder swings with the outer peripheral parts of the bearing portions, whereby the pickup roller is vertically movable.

6 Claims, 11 Drawing Sheets

(56) References Cited

U.S. PATENT DOCUMENTS

2015/0344245 A1* 12/2015 Matsuo ..... B65H 1/266
271/264

* cited by examiner

SHEET FEEDING DEVICE AND IMAGING FORMING APPARATUS PROVIDED WITH SAME

This application is based on Japanese Patent Application No. 2015-147529 filed with the Japan Patent Office on Jul. 27, 2015, the contents of which are hereby incorporated by reference.

BACKGROUND

The present disclosure relates to a sheet feeding device and an image forming apparatus provided with the same.

Conventionally, a sheet feeding device for feeding a sheet is known to be provided in an image forming apparatus. The sheet feeding device includes a sheet storage portion, a pickup roller and a sheet feed roller. When the pickup roller is rotated, a sheet stored in the sheet storage portion is fed in a predetermined conveying direction. The sheet feed roller further conveys the sheet fed by the pickup roller.

Further, a technique for supporting a pickup roller and a sheet feed roller in a unit via bearing members is known. Such pickup roller and sheet feed roller are exchangeably mounted in the unit.

SUMMARY

A sheet feeding device according to one aspect of the present disclosure includes a sheet feeding unit and a feed unit. The sheet feeding unit includes a housing having a pair of wall portions. The feed unit is detachably attachable to the housing. The feed unit includes a pickup roller configured to feed a sheet and a sheet feed roller configured to further convey the sheet fed by the pickup roller. The feed unit includes a holder, a shaft and a pair of bearing portions. The holder has a pair of side walls each having a bearing hole portion open on one end side thereon in a sheet conveying direction. The shaft extends between the pair of side walls and serves as a rotary shaft of the sheet feed roller. The pair of bearing portions are mounted in the bearing hole portions to project outwardly in an axial direction of the shaft from the side walls and rotatably supports the shaft. The housing includes a pair of shaft supporting portions provided on the pair of wall portions and capable of supporting outer peripheral parts of the bearing portions projecting from the side walls. When the feed unit is attached to the housing and the pair of bearing portions are supported in the pair of shaft supporting portions, the holder swings with the outer peripheral parts of the bearing portions as a swing axis, whereby the pickup roller is vertically movable.

Further, an image forming apparatus according to another aspect of the present disclosure includes the above sheet feeding device and an image forming unit. The image forming unit forms an image on the sheet fed by the sheet feeding device.

DETAILED DESCRIPTION

Figure 1:
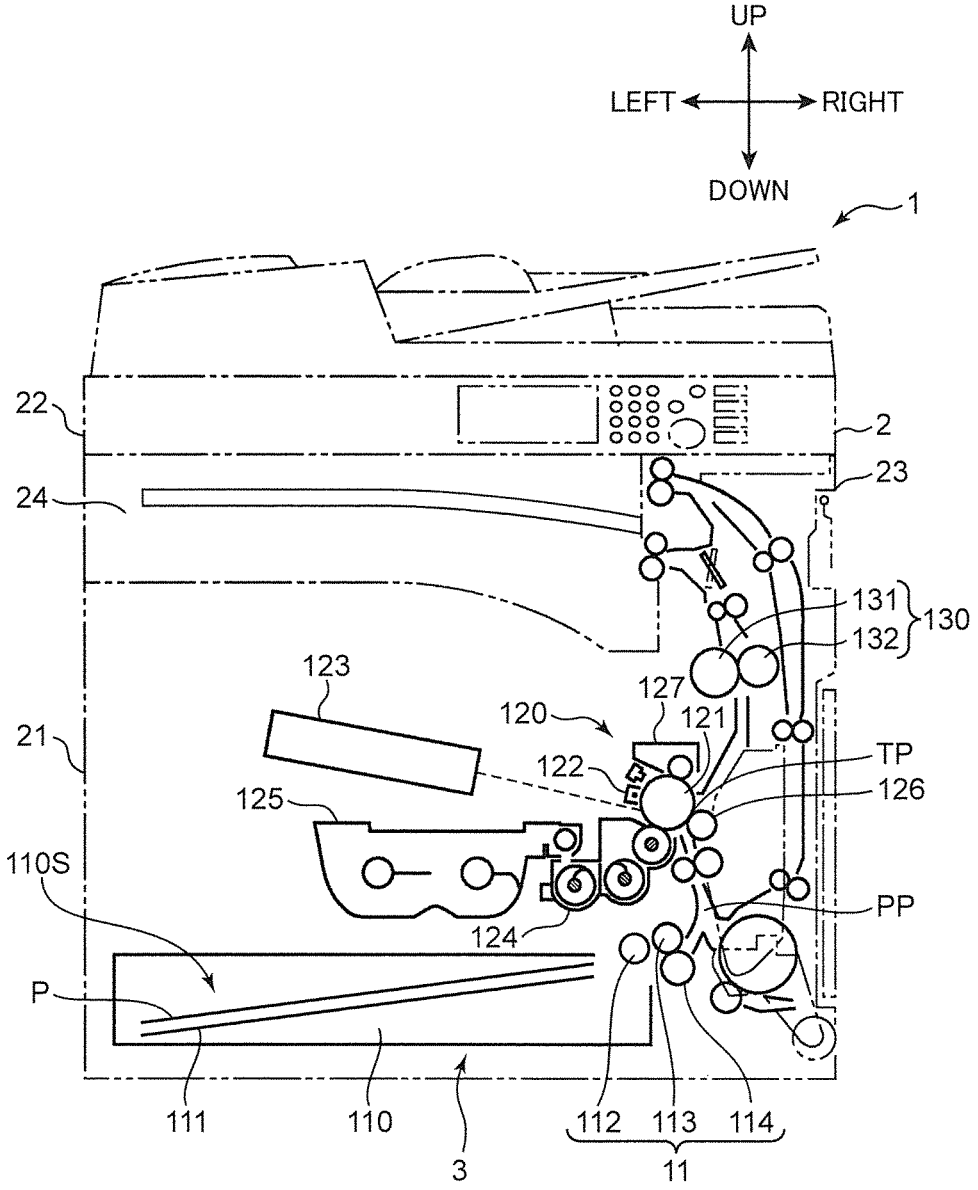
FIG. 1 is a sectional view of an image forming apparatus according to one embodiment of the present disclosure.

Hereinafter, one embodiment of the present disclosure is described with reference to the drawings. FIG. 1 is an internal sectional view of an image forming apparatus 1 according to the one embodiment of the present disclosure. The image forming apparatus 1 shown in FIG. 1 is a so-called monochrome printer. In other embodiments, the image forming apparatus may be a color printer, a facsimile machine, a complex machine provided with these functions or another apparatus for forming a toner image on a sheet. Note that direction-indicating terms such as "upper" and "lower", "front" and "back", "left" and "right" used in the following description are merely for the purpose of clarifying the description and do not limit the principle of the image forming apparatus at all. Further, in the following description, a term "sheet" means a copy sheet, a coated paper, an OHP sheet, a cardboard, a postcard, a tracing paper or another sheet material to which an image forming process is to be applied or another sheet material to which an arbitrary process other than the image forming process is to be applied.

The image forming apparatus 1 includes a substantially rectangular parallelepipedic main housing 2. The main housing 2 includes a substantially rectangular parallelepipedic lower housing 21, a substantially rectangular parallelepipedic upper housing 22 arranged above the lower housing 21 and a coupling housing 23 coupling the lower housing 21 and the upper housing 22. A sheet having a printing process applied thereto is discharged to a discharge space 24 enclosed by the lower housing 21, the upper housing 22 and the coupling housing 23.

The image forming apparatus 1 includes a sheet feeding device 3 and an image forming unit 120. The sheet feeding device 3 includes a sheet cassette 110 and a sheet feeding portion 11. The sheet feeding portion 11 includes a pickup roller 112, a sheet feed roller 113 and a retard roller 114. The sheet feeding portion 11 feeds a sheet P in a rightward direction (conveying direction) from the sheet cassette 110 to a sheet conveyance path PP. The sheet conveyance path PP is a conveyance path arranged to extend from the sheet feeding portion 11 and pass through a transfer position TP arranged in the image forming unit 120.

The sheet cassette 110 includes a sheet storage portion 110S. Sheets P are stored in the sheet storage portion 110S. The sheet cassette 110 can be pulled out in a forward direction (direction forward of the plane of FIG. 1) from the lower housing 21 and mounted into the lower housing 21 along a backward direction (direction backwardly of the plane of FIG. 1). Further, the sheet cassette 110 includes a lift plate 111 on the upper surface of which the sheets P are to be placed. The lift plate 111 is arranged in the sheet storage portion 110S and vertically movable. When the lift plate 111 moves upward, the leading edges of the sheets P are pushed upward.

The pickup roller 112 is arranged above the leading edges of the sheets P pushed upward by the lift plate 111. When the pickup roller 112 rotates, the sheet P is fed from the sheet cassette 110. Note that the sheet P is fed in a sheet feeding direction (rightward direction) intersecting with a mounting direction of the sheet cassette 110 in the lower housing 21. The sheet feed roller 113 is arranged downstream of the pickup roller 112 in the sheet conveying direction. The sheet feed roller 113 feeds the sheet P further toward a downstream side in the sheet conveying direction.

The image forming unit 120 forms an image on the sheet P fed from the sheet feeding portion 11. The image forming unit 120 includes a photoconductive drum 121, a charger 122, an exposure device 123, a developing device 124, a toner container 125, a transfer roller 126 and a cleaning device 127.

The image forming apparatus 1 further includes a fixing device 130 arranged downstream of the image forming unit 120 in the conveying direction and configured to fix a toner image on the sheet P. The fixing device 130 includes a heating roller 131 for melting toner on the sheet P and a pressure roller 132 for bringing the sheet P into close contact with the heating roller 131.

Figure 2:
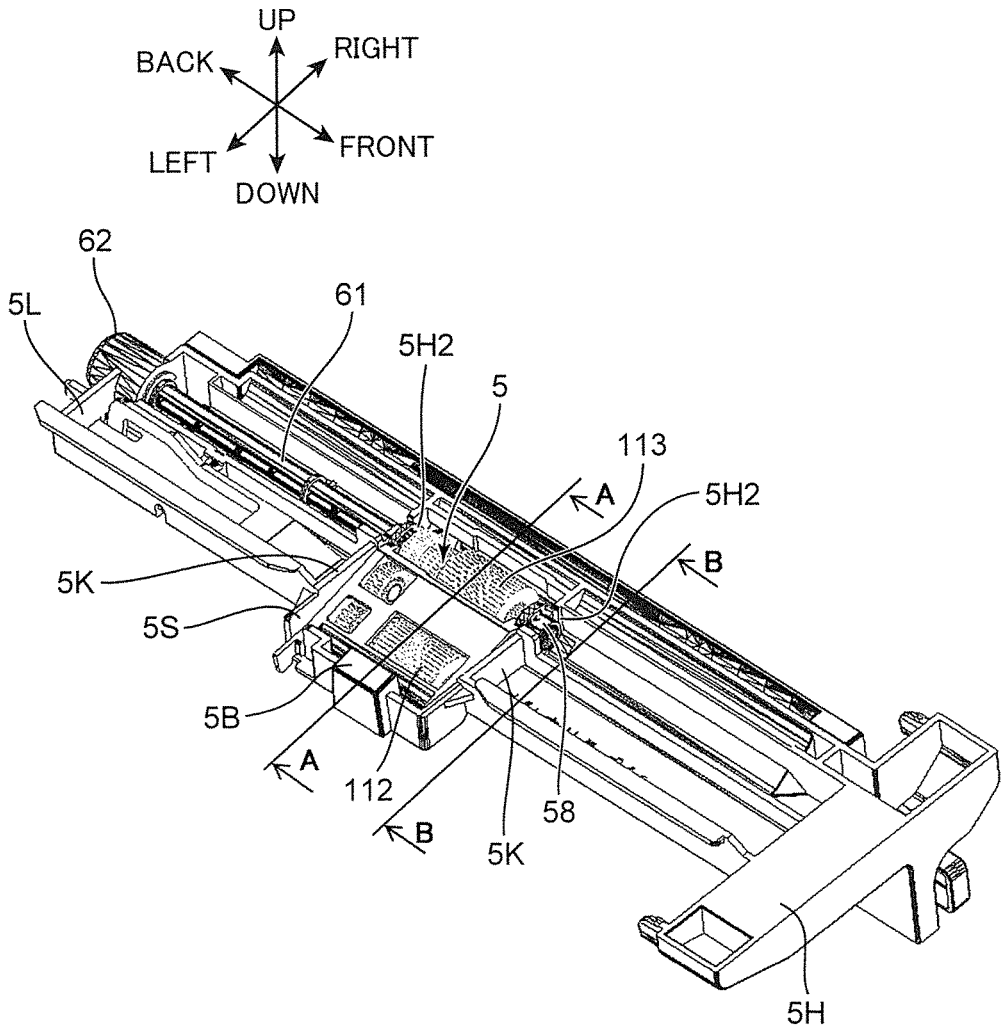
FIG. 2 is a perspective view of a sheet feeding device according to the one embodiment of the present disclosure.
Figure 3:
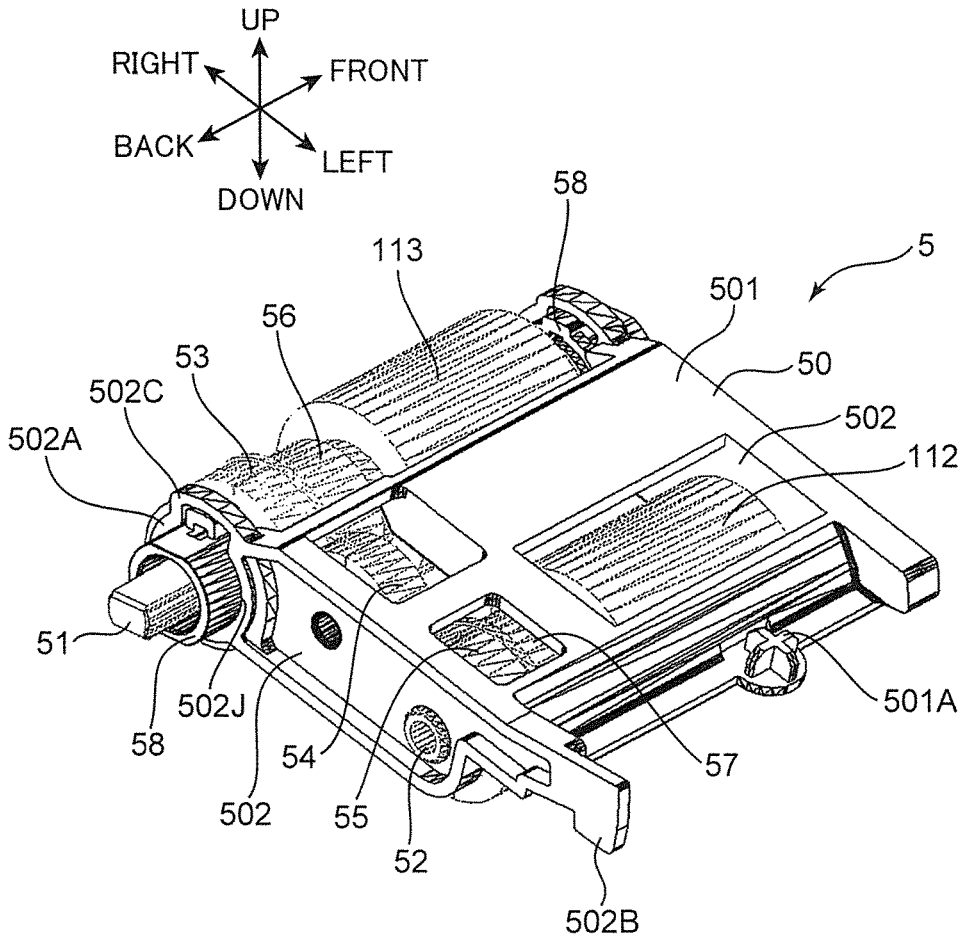
FIG. 3 is a perspective view of a feed unit according to the one embodiment of the present disclosure.
Figure 4A:
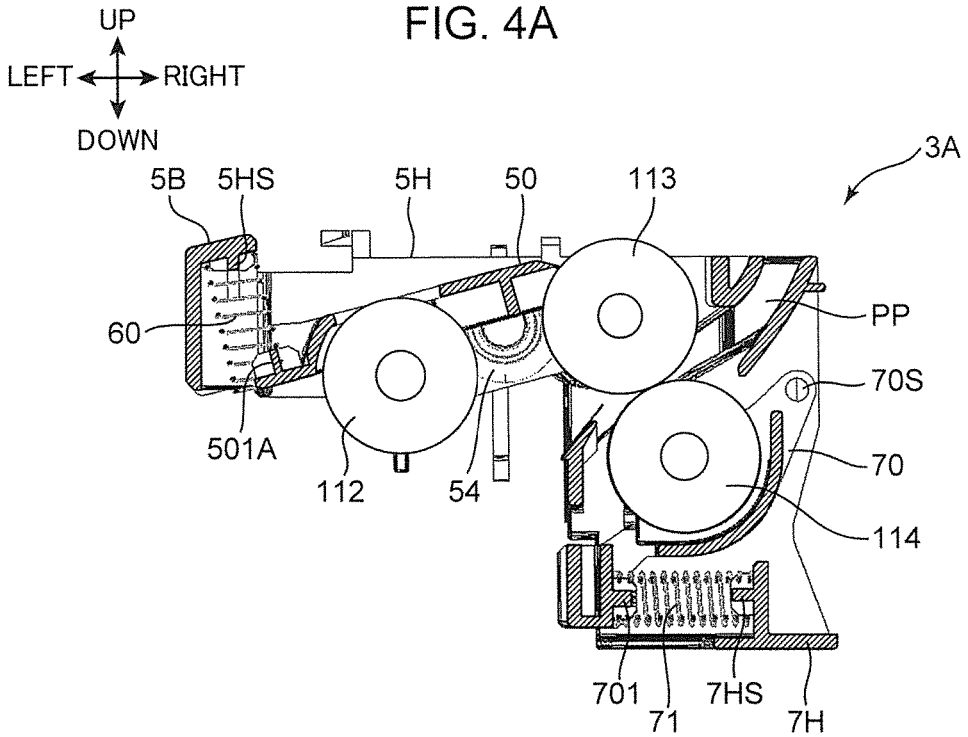
FIG. 4A is a sectional view showing a sheet feeding unit according to the one embodiment of the present disclosure.
Figure 4B:
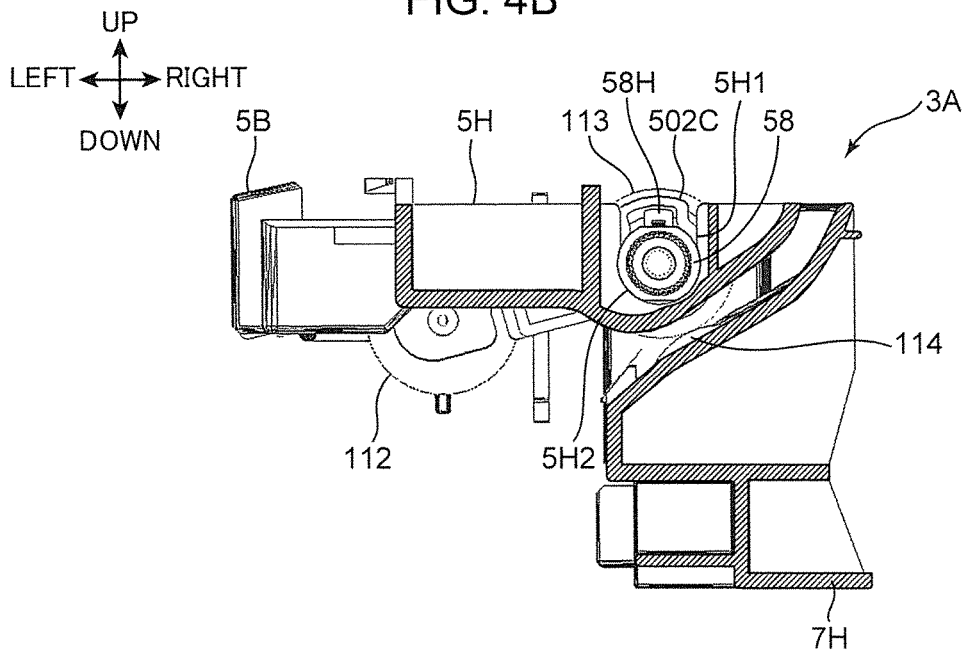
FIG. 4B is a sectional view showing the sheet feeding unit according to the one embodiment of the present disclosure.
Figure 5:
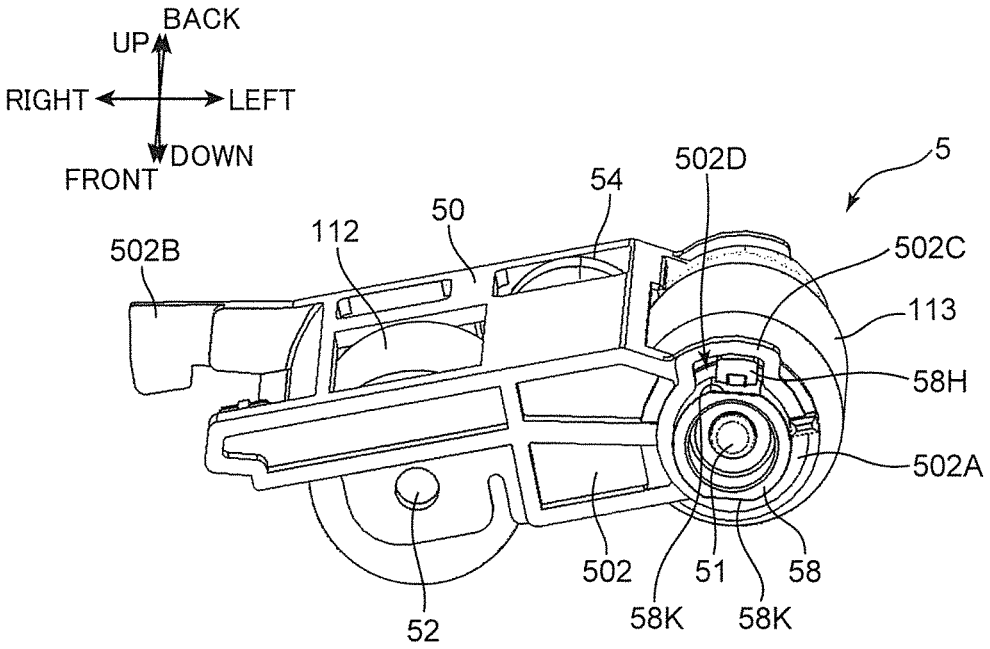
FIG. 5 is a perspective view of the feed unit according to the one embodiment of the present disclosure.
Figure 6A:
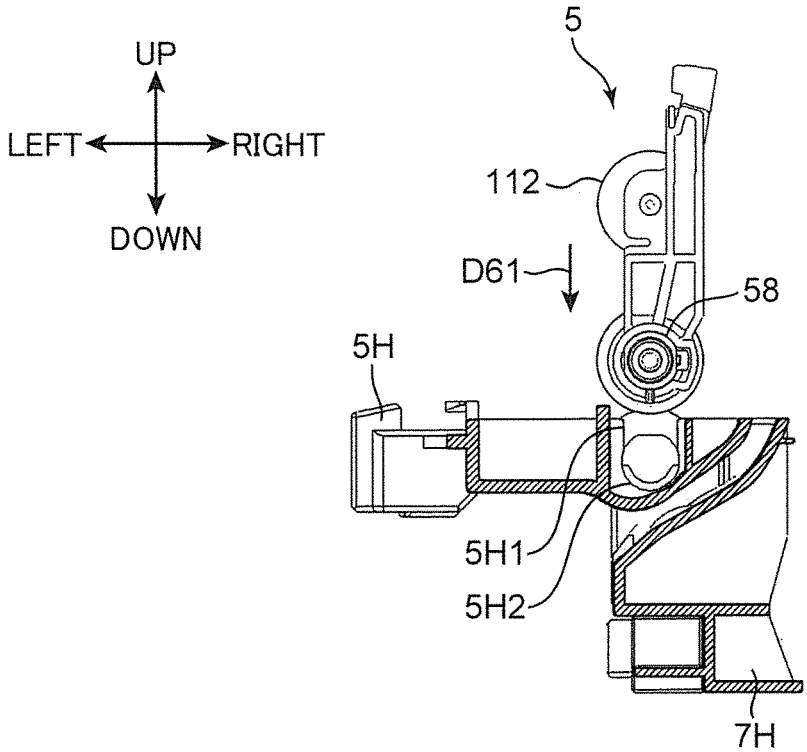
FIG. 6A is a front view showing a state where the feed unit is being attached to a housing according to the one embodiment of the present disclosure.
Figure 6B:
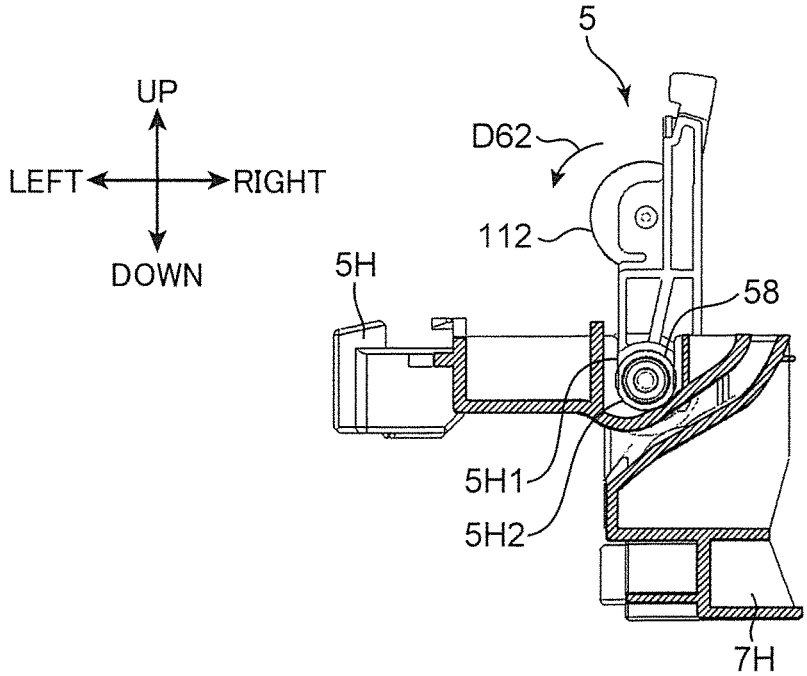
FIG. 6B is a front view showing the state where the feed unit is being attached to the housing according to the one embodiment of the present disclosure.
Figure 6C:
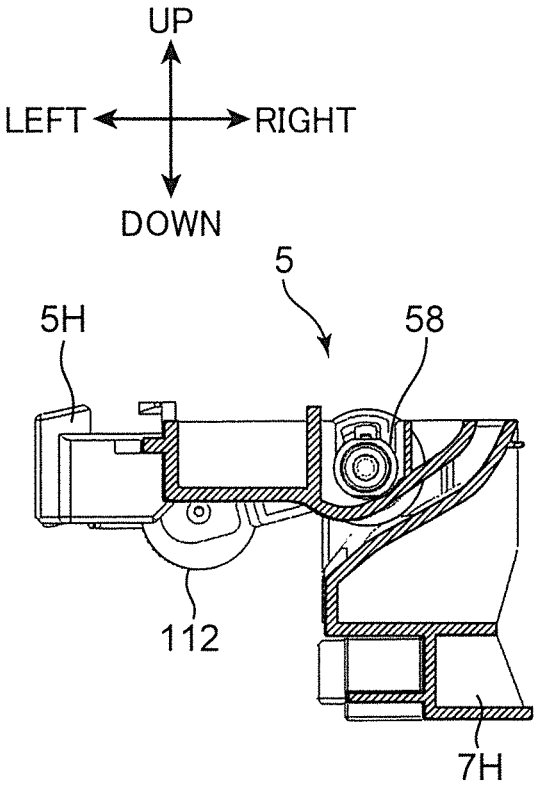
FIG. 6C is a front view showing the state where the feed unit is being attached to the housing according to the one embodiment of the present disclosure.
Figure 7A:
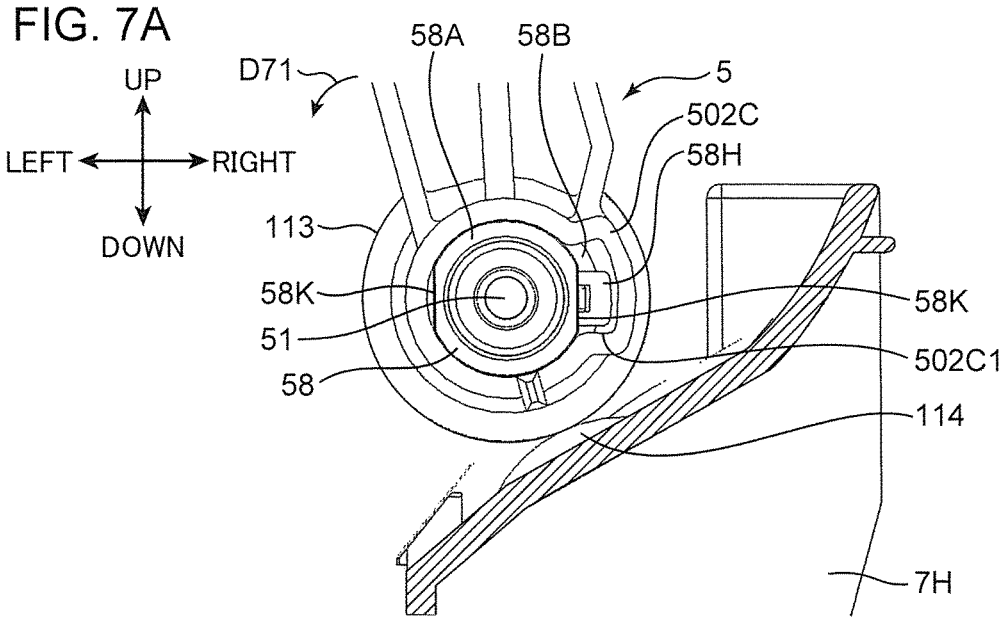
FIG. 7A is an enlarged view showing the state where the feed unit is being attached to the housing according to the one embodiment of the present disclosure.
Figure 7B:
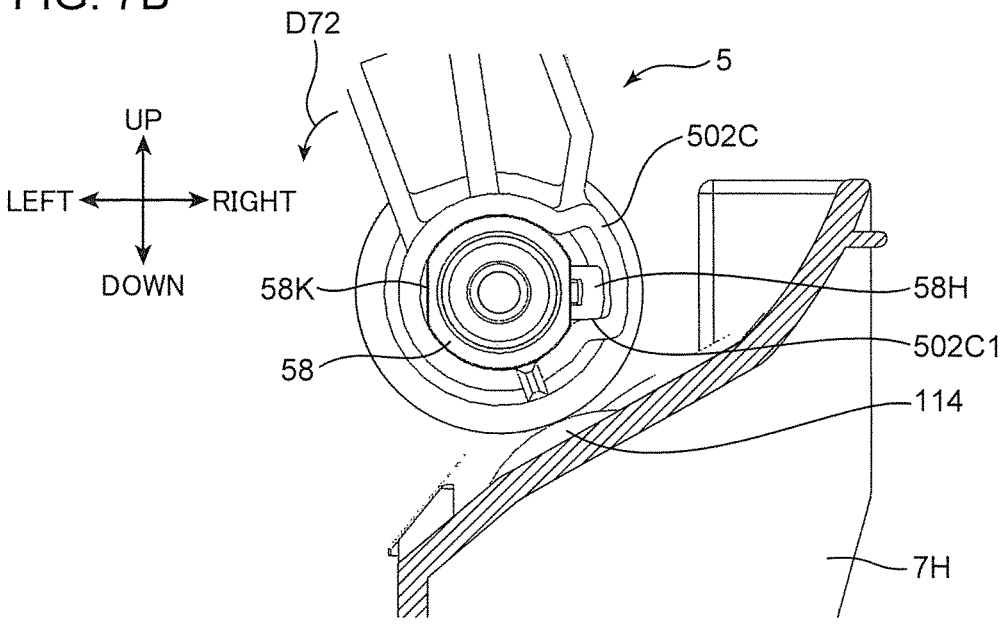
FIG. 7B is an enlarged view showing the state where the feed unit is being attached to the housing according to the one embodiment of the present disclosure.
Figure 7C:
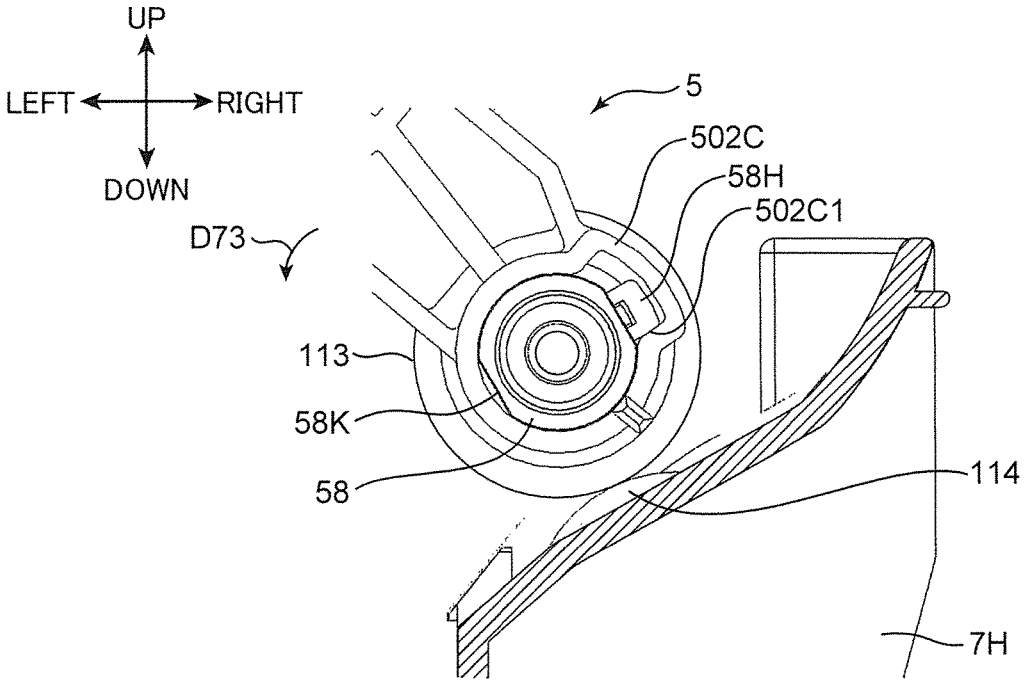
FIG. 7C is an enlarged view showing the state where the feed unit is being attached to the housing according to the one embodiment of the present disclosure.

Next, the sheet feeding device 3 according to this embodiment is described in more detail with reference to FIGS. 2 to 7E. FIG. 2 is a perspective view showing a part of the sheet feeding device 3 according to this embodiment. FIG. 3 is a perspective view of a feed unit 5 according to this embodiment. FIG. 4A is a sectional view showing a sheet feeding unit 3A which is a part of the sheet feeding device 3. FIG. 4B is a sectional view showing the sheet feeding unit 3A. Note that FIG. 4A is a sectional view along line A-A of FIG. 2 and FIG. 4B is a sectional view along line B-B of FIG. 2. FIG. 5 is a perspective view of the feed unit 5. Further, FIGS. 6A to 6C are front views showing a state where the feed unit 5 is being attached to a unit housing 5H. FIGS. 7A to 7 are enlarged views showing the state where the feed unit 5 is being attached to the unit housing 5H.

With reference to FIGS. 2, 4A and 4B, the sheet feeding device 3 includes the sheet feeding unit 3A. The sheet feeding unit 3A includes the unit housing 5H (housing), the feed unit 5, a transmission shaft 61 and an input gear 62. The feed unit 5 includes the pickup roller 112 and the sheet feed roller 113 described above.

The unit housing 5H is detachably mounted into the lower housing 21. The unit housing 5H is a unit extending long in a front-back direction and L-shaped in a side view. A pair of inner walls 5K (wall portions) extending in a lateral direction are provided in a central part of the unit housing 5H in the front-back direction. Amounting portion 5S is formed between the pair of inner walls 5K. The feed unit 5 is mounted into the mounting portion 5S from above. Further, a rear wall 5L is provided on a rear end side of the unit housing 5H. The transmission shaft 61 is rotatably supported by the rear one of the pair of inner walls 5K and the rear wall 5L. The transmission shaft 61 is a shaft for transmitting a rotational drive force to the feed unit 5. Further, the input gear 62 is fixed to a rear end part of the transmission shaft 61. When the unit housing 5H is mounted into the lower housing 21, the input gear 62 is coupled to an unillustrated driver in the lower housing 21. As a result, the rotational drive force is transmitted to the feed unit 5 via the input gear 62 and the transmission shaft 61.

With reference to FIG. 3, the feed unit 5 includes a sheet feeding holder 50 (holder), a sheet feed roller shaft 51, a pickup roller shaft 52, a sheet feed roller input gear 53, an idler gear 54, a pickup roller input gear 55, a sheet feed roller one-way gear 56, a pickup roller one-way gear 57 and a pair of bearings 58 (bearing portions).

The sheet feeding holder 50 supports each member of the feed unit 5. The sheet feeding holder 50 has a ceiling plate 501 and a pair of side walls 502. The ceiling plate 501 constitutes an upper surface portion of the sheet feeding holder 50. Note that, as shown in FIG. 3, the ceiling plate 501 is formed with a plurality of rectangular openings. The side walls 502 are coupled to front and rear edges of the ceiling plate 501. The ceiling plate 501 includes a sheet feeding holder spring locking portion 501A (FIG. 3). The sheet feeding holder spring locking portion 501A is a cross-shaped projection projecting upward from a left end part of the sheet feeding holder 501 in a central part of the sheet feeding holder 501 in the front-back direction. A first biasing spring 60 to be described later is locked to the sheet feeding holder spring locking portion 501A.

Further, the sheet feeding holder 50 includes bearing mounting portions 502A, a detecting piece 502B and projecting piece housing portions 502C.

Figure 7D:
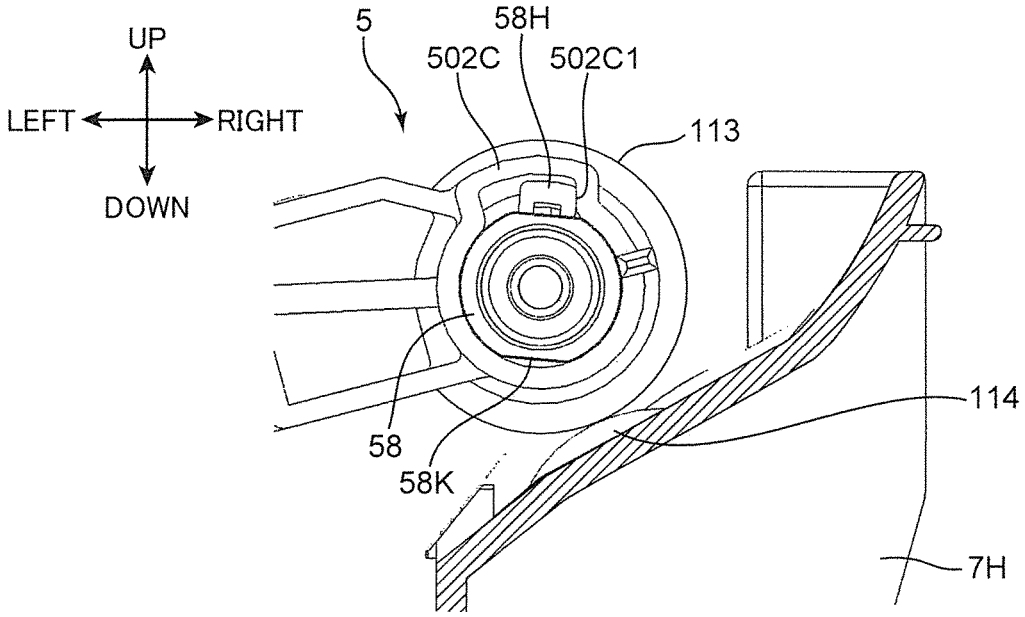
FIG. 7D is an enlarged view showing the state where the feed unit is being attached to the housing according to the one embodiment of the present disclosure.
Figure 7E:
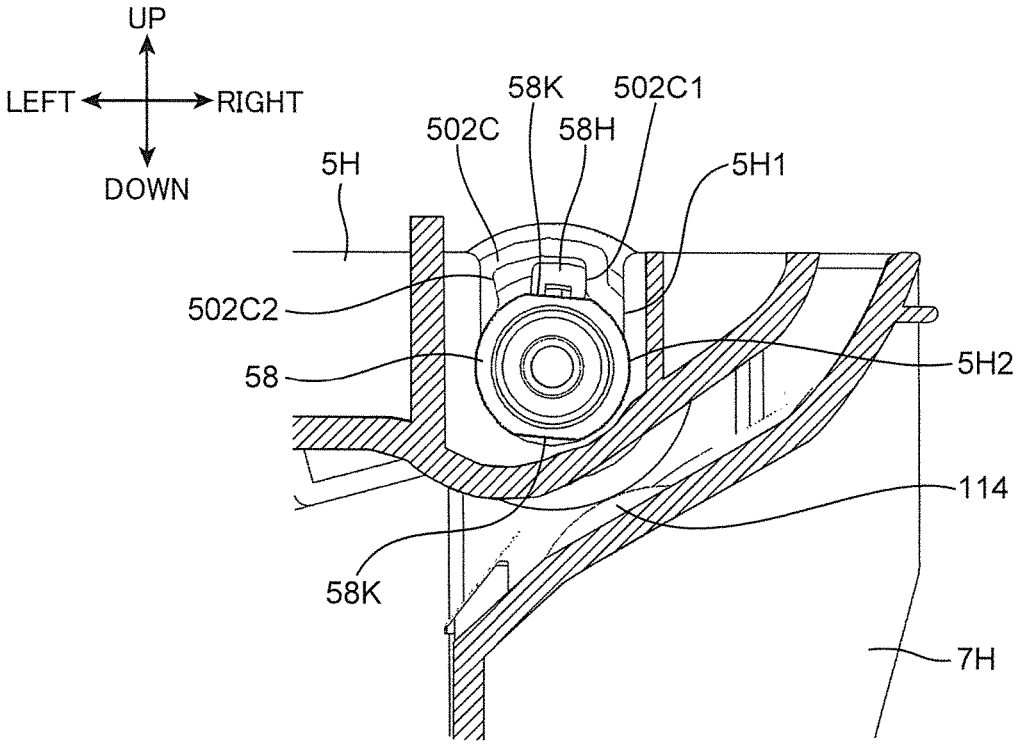
FIG. 7E is an enlarged view showing the state where the feed unit is being attached to the housing according to the one embodiment of the present disclosure.

The bearing mounting portion 502A is formed on each of right end parts of the pair of side walls 502. A bearing hole portion 502J is open on the bearing mounting portion 502A. The bearing 58 is mounted into the bearing hole portion 502J. The detecting piece 502B is a projecting piece projecting from a left end part of the rear one of the pair of side walls 502. The detecting piece 502B is arranged to face an unillustrated PI (photointerrupter) sensor provided in the lower housing 21 (FIG. 1). The PI sensor detects the detecting piece 502B, whereby the swing of the sheet feeding holder 50 is detected as described later. The projecting piece housing portion 502C is connected in contact with the bearing mounting portion 502A. The projecting piece housing portion 502C is projecting upward from the bearing mounting portion 502A and has an arcuate shape. A guide hole 502D (FIG. 5) communicating with the bearing hole portion 502J is formed in the projecting piece housing portion 502C. The guide hole 502D is open to have a predetermined length along a circumferential direction in the rotation of the sheet feed roller 113 and a bearing projecting piece 58H (FIG. 5) of the bearing 58 is housed therein. In other words, the guide hole 502D bulges radially outwardly from the peripheral edge of the bearing hole portion 502J and communicates with the bearing hole portion 502J. The guide hole 502D is a hole portion open with the predetermined circumferential length along the circumferential direction and engageable with the later-described bearing projecting piece 58H of the bearing 58 inside. Note that the projecting piece housing portion 502C includes a first contact portion 502C1 (FIG. 7E) (inner wall portion) and a second contact portion 502C2 (FIG. 7E). The first and second contact portions 502C1 and 502C2 are wall portions defining one and the other circumferential ends of the projecting piece housing portion 502C.

The sheet feed roller shaft 51 (shaft) extends between the pair of side walls 502 on a right end side of the sheet feeding holder 50. The sheet feed roller shaft 51 is rotatably supported in the bearings 58 and serves as a rotary shaft in the rotation of the sheet feed roller 113. As shown in FIG. 3, a rear end part of the sheet feed roller shaft 51 is partly shaped to be flat. By coupling the aforementioned transmission shaft 61 to a rear end part of the sheet feed roller shaft 51, the sheet feed roller shaft 51 and the transmission shaft 62 are integrally rotatable.

The pickup roller shaft 52 extends between the pair of side walls 502 on a left end side (upstream side in the conveying direction) of the sheet feeding holder 50. The pickup roller shaft 52 serves as a rotary shaft in the rotation of the pickup roller 112.

The sheet feed roller input gear 53 is a gear fixed to the sheet feed roller shaft 51 at an axially inner side of the rear side wall 502 and rotates integrally with the sheet feed roller shaft 51. The idler gear 54 is rotatably supported on the rear side wall 502. The idler gear 54 is a gear engaged with the sheet feed roller input gear 53 and also engaged with the pickup roller input gear 55 on a side opposite to the sheet feed roller input gear 53. The pickup roller input gear 55 is a gear for transmitting the rotational drive force to the pickup roller 112 and rotates integrally with the pickup roller shaft 52. The sheet feed roller one-way gear 56 transmits the rotational drive force of the sheet feed roller shaft 51 to the sheet feed roller 113. Further, the sheet feed roller one-way gear 56 prevents the reverse rotation of the sheet feed roller 113. Similarly, the pickup roller one-way gear 57 transmits the rotational drive force transmitted from the pickup roller input gear 55 to the pickup roller shaft 52 to the pickup roller 112. Further, the pickup roller one-way gear 57 idly rotates the pickup roller 112 in a state where drive transmission to the pickup roller 112 is shut off.

The bearing 58 is mounted in the bearing mounting portion 502A (FIG. 3) to project outwardly of the sheet feed roller shaft 51 in an axial direction from the side wall 502. The bearing 58 rotatably supports the sheet feed roller shaft 51. Specifically, the bearing 58 includes a cylindrical portion 58A (FIG. 7A) and a flange portion 58B (FIG. 7A) (flange). The sheet feed roller shaft 51 is arranged to penetrate through the cylindrical interior of the cylindrical portion 58A. The flange portion 58B is arranged on an end part of the cylindrical portion 58A in the axial direction. An outer diameter of the flange portion 58B is set to be larger than that of the cylindrical portion 58A. The flange portion 58B comes into contact with the axially inner side surface of the side wall 502 (front side surface of the side wall 502 in the case of the rear side wall 502) and the cylindrical portion 58A is inserted into the bearing hole portion 502J (FIG. 3), whereby the bearing 58 is supported on the side wall 502 of the sheet feeding holder 50.

Further, the bearing 58 includes a pair of flat portions 58K (D-cut portion) and the bearing projecting piece 58H (projection portion) (FIG. 5). The flat portion 58K includes a flat surface formed by cutting a part of an outer peripheral part of the cylindrical portion 58A along a flat surface. The pair of flat portions 58K are arranged at opposite sides in a radial direction. The bearing projecting piece 58H is a projection portion projecting radially outwardly from one of the pair of flat portions 58K. When the bearing 58 is mounted on the sheet feeding holder 50, the bearing projecting piece 58H is arranged in the guide hole 502D. As a result, the bearing 58 is rotatable in the circumferential direction with respect to the side wall 502 by a movement of the bearing projecting piece 58H along the circumferential direction in the guide hole 502D between the first contact portion 502C1 (FIG. 7E) and the second contact portion 502C2 (FIG. 7E).

With reference to FIG. 4A, the feed unit 5 includes a first biasing spring 60. Further, the unit housing 5H includes a box portion 5B (FIGS. 2 and 4A). A housing spring locking portion 5HS is provided in the box portion 5B. The housing spring locking portion 5HS is a cross-shaped projection projecting downward from a ceiling plate of the box portion 5B. The first biasing spring 60 is a spring member arranged to be compressed between the housing spring locking portion 5HS and the sheet feeding holder spring locking portion 501A as shown in FIG. 4A. The first biasing spring 60 biases the sheet feeding holder 50 such that the pickup roller 112 moves downward with the bearings 58 as a center.

Further, with reference to FIG. 4B, the unit housing 5H includes insertion portions 5H1 and circular bearing supporting portions 5H2 (shaft supporting portions, shaft hole portions). The insertion portion 5H1 and the bearing supporting portion 5H2 are respectively formed on the inner walls 5K (FIG. 2) of the unit housing 5H. The bearing supporting portion 5H2 is a shaft hole into which an outer peripheral part (cylindrical portion 58A) of the bearing 58 projecting from the side wall 502 is inserted and which has an inner diameter capable of pivotally supporting this outer peripheral part. The insertion portions 5H1 are open (cut) to communicate from the upper end edges (end edges) of the pair of inner walls 5K of the unit housing 5H to the bearing supporting portions 5H2 along a radial direction in the rotation of the sheet feed roller 113. The insertion portion 5H1 is defined by a pair of facing surfaces parallel to each other. A distance between the pair of facing surfaces is set to be longer than a width between the pair of flat portions 58K of the bearing 58 and smaller than a largest outer diameter of the outer peripheral part of the bearing 58.

Further, the unit housing 5H includes a retard unit 7H, a retard holder 70 and a second biasing spring 71 (FIG. 4A). The retard unit 7H is a unit provided in the unit housing 5H. The retard holder 70 is swingably supported in the retard unit 7H. The retard holder 70 is a supporting member for rotatably supporting the retard roller 114. The retard holder 70 includes a holder fulcrum portion 70S and a retard holder spring locking portion 701. The holder fulcrum portion 70S is arranged on a right end part of the upper end of the retard holder 70. The holder fulcrum portion 70S serves as a fulcrum of the swing of the retard holder 70. The retard holder spring locking portion 701 is arranged on a lower end part on the left end of the retard holder 70. The retard holder spring locking portion 701 is a cross-shaped projection projecting rightward from the retard holder 70. On the other hand, the retard unit 7H includes a frame spring locking portion 7HS. The frame spring locking portion 7HS is a cross-shaped projection arranged to the right of and at a distance from the retard holder spring locking portion 701 and projecting leftward.

As shown in FIG. 4A, the second biasing spring 71 is arranged to be compressed between the retard holder spring locking portion 701 and the frame spring locking portion 7HS. A lower end part of the retard holder 70 is biased leftward by a biasing force of the second biasing spring 71. As a result, the retard holder 70 is rotated about the holder fulcrum portion 70S and the retard roller 114 comes into contact with the sheet feed roller 113.

Next, how to attach the feed unit 5 to the unit housing 5H is described mainly with reference to FIGS. 6A to 7E. In attaching, detaching or exchanging the feed unit 5, the unit housing 5H is first pulled out forward from the lower housing 21. Then, as shown in FIG. 6A, the feed unit 5 is set in a posture to extend in a vertical direction such that the pickup roller 112 is located above the sheet feed roller 113 (FIG. 5). In this state, the bearings 58 are inserted into the insertion portions 5H1 as shown by an arrow D61. At this time, the cylindrical portion 58A of the bearing 58 passes through the insertion portion 5H1 in a state where the pair of flat portions 58K of the bearing 58 extend along the pair of facing surfaces of the insertion portion 5H, i.e. the pair of flat portions 58K of the bearing 58 are facing the pair of facing surfaces of the insertion portion 5H1. Thereafter, the cylindrical portions 58A of the bearings 58 are rotatably supported in the bearing supporting portions 5H2 (FIG. 6B). At this time, the sheet feed roller 113 is arranged to face the retard roller 114. As just described, an operator can easily insert the feed unit 5 into the unit housing 5H by fitting the pairs of flat portions 58K into the insertion portions 5H1 of the unit housing 5H.

In a state where the feed unit 5 is arranged to extend in the vertical direction with respect to the unit housing 5H, the feed unit 5 (sheet feeding holder 50) is rotated about the bearings 58 as shown by an arrow D62 of FIG. 6B and an arrow D71 of FIG. 7A. At this time, the first contact portions 502C1 (FIG. 7B) of the side walls 502 press the bearing projecting pieces 58H upward (FIG. 7B), whereby the side walls 502 of the sheet feeding holder 50 and the bearings 58 integrally rotate. When the feed unit 5 is further rotated as shown by an arrow D72 of FIG. 7B and an arrow D73 of FIG. 7C, the feed unit 5 is eventually attached to the unit housing 5H as shown in FIGS. 6C, 7D and 7E. As a result, the pickup roller 112 is arranged at an initial position to be able to come into contact with the upper surface of the sheet P. Note that since the pairs of flat portions 58K are arranged in a direction intersecting with the pairs of facing surfaces of the insertion portions 5H1 in a process of reaching a state shown in FIG. 7D from a state shown in FIG. 7B, the detachment of the feed unit 5 from the unit housing 5H is prevented during use. Note that, in detaching the feed unit 5 from the unit housing 5H, a procedure opposite to the above one is carried out. At this time, the bearings 58 rotate integrally with the sheet feeding holder 50 by the second contact portions 502C2 (FIG. 7E) pressing the bearing projecting pieces 58H. Then, by arranging the bearings 58 again such that an extending direction of the pairs of flat portions 58K and an extending direction of the pairs of facing surfaces of the insertion portions 5H1 match, the feed unit 5 is pulled out upward.

When the feed unit 5 is attached to the unit housing 5H as shown in FIG. 6C, the first biasing spring 60 is mounted between the feed unit 5 and the unit housing 5H by the operator (FIG. 4A). When the unit housing 5H is mounted into the lower housing 21 thereafter, the pickup roller 112 located at the above initial position is arranged above downstream end parts of the sheets P stored in the sheet storage portion 110S (FIG. 1) in the conveying direction.

The pickup roller 112 is vertically movable between the aforementioned initial position and a sheet feeding position, which is located above this initial position and where the sheet P is fed, as the sheet feeding holder 50 swings about the bearings 58 by being pushed up by the lift plate 111. If the lift plate 111 is located at a bottom side of the sheet cassette 110, the pickup roller 112 is arranged at a lower end position by a biasing force of the first biasing spring 60 (FIG. 4A). At this time, the bearing projecting pieces 58H are arranged near the second contact portions 502C2 in the guide holes 502D. On the other hand, if the lift plate 111 is elevated by the unillustrated driver, the uppermost sheet P pushes up the pickup roller 112. Eventually, when the detecting piece 502B is detected by the unillustrated PI sensor, the elevation of the lift plate 111 is stopped. As a result, the pickup roller 112 is arranged at the sheet feeding position. At this time, the bearing projecting pieces 58H are arranged near the first contact portions 502C1 in the guide holes 502D as shown in FIG. 7E. In this embodiment, as just described, the bearing projecting pieces 58H of the bearings 58 are arranged in the guide holes 502D to suppress the collision of the bearing projecting pieces 58H with the first and second contact portions 502C1, 502C2 (the bearing projecting pieces 58H do not contact the first and second contact portions 502C1, 502C2) while the pickup roller 112 moves between the initial position and the sheet feeding position. Thus, the rotation of the bearings 58 is suppressed while the sheet feeding holder 50 swings to vertically move the pickup roller 112. As a result, the detachment of the bearings 58 is suppressed.

In the sheet feeding device 3, when the retard roller 114 is pressed against the sheet feed roller 113 by the biasing force of the second biasing spring 71 (FIG. 4A), a pressing force is also applied to the sheet feed roller shaft 51. If the sheet feed roller shaft 51 is directly pivotally supported on the side walls 502 of the sheet feeding holder 50 without via the bearings 58, the side walls 502 and the sheet feed roller shaft 51 strongly rub against each other by the pressing force applied to the sheet feed roller shaft 51. As a result, the swing of the sheet feeding holder 50 may be obstructed. On the other hand, in this embodiment, the bearings 58 are arranged between the sheet feed roller shaft 51 and the side walls 502. Further, the bearings 58 are supported on the unit housing 5H and the sheet feed roller shaft 51 is pivotally supported in the bearings 58. On the other hand, the sheet feeding holder 50 is pivotally supported by being externally fitted to the bearings 58. Thus, even if the retard roller 114 comes into contact with the sheet feed roller 113 to apply a load to the sheet feed roller shaft 51, the sheet feeding holder 50 is less likely to be directly affected. Specifically, the regulation of the swing of the sheet feeding holder 50 by the pressing force applied to the sheet feed roller 113 is suppressed when the retard roller 114 comes into contact with the sheet feed roller 113. Thus, the sheet feeding holder 50 can smoothly swing. As a result, the pickup roller 112 is stably vertically moved and the feed of the sheet P is stably realized. Note that the same holds also when a known sheet feed pad or the like comes into contact with the sheet feed roller 113 instead of the retard roller 114.

Further, since the bearings 58 are mounted on the feed unit 5 in this embodiment, the bearings 58 are prevented from coming off when the feed unit 5 is attached and detached. Particularly, the flange portions 58B of the bearings 58 come into contact with the axially inner side surfaces of the side walls 502 and the cylindrical portions 58A are inserted into the bearing hole portions 502J (FIG. 3). Thus, the bearings 58 are further prevented from coming off from the side walls 502 of the sheet feeding holder 50.

Further, in this embodiment, the bearing 58 includes the bearing projecting piece 58H projecting radially outwardly from the cylindrical portion 58A and the side wall 502 of the sheet feeding holder 50 includes the guide hole 502D for housing the bearing projecting piece 58H of the bearing 58 inside. The side wall 502 is rotatable in the circumferential direction relative to the bearing 58 by a movement of the bearing projecting piece 58H along the circumferential direction in the guide hole 502D. Thus, the side wall 502 of the sheet feeding holder 50 is rotatable relative to the bearing 58 by a movement of the bearing projecting piece 58H in the guide hole 502D. Therefore, the swing of the sheet feeding holder 50 is smoothly realized with the bearings 58 supported in the bearing supporting portions 5H2 of the unit housing 5H.

Further, in this embodiment, the bearing 58 includes the pair of flat portions 58K formed by partly cutting the outer peripheral part of the cylindrical portion 58A along flat surfaces. The bearing projecting piece 58H projects from one of the pair of flat portions 58K. Further, the bearing supporting portion 5H2 of the unit housing 5H includes the shaft hole portion for supporting the cylindrical portion 58A of the bearing 58 projecting from the side wall 502 and the insertion portion 5H1 open to allow communication between the outer peripheral edge of the unit housing 5H and the bearing supporting portion 5H2 along the radial direction in the rotation of the sheet feed roller and having a width corresponding to the outer diameter of the bearing 58 between the pair of flat portions 58K. By rotating the feed unit 5 about the bearings 58 after the pairs of flat portions 58K pass through the insertion portions 5H1 while being fitted into the insertion portions 5H1 and the cylindrical portions 58A of the bearings 58 are supported in the bearing supporting portions 5H2, the feed unit 5 is attached to the unit housing 5H. As just described, the feed unit 5 is easily attached to the unit housing 5H by fitting the pairs of flat portions 58K into the insertion portions 5H1.

Further, in this embodiment, the side wall 502 of the sheet feeding holder 50 includes the first contact portion 502C1 defining one circumferential end of the guide hole 502D. When the feed unit 5 is rotated about the bearings 58 after the pairs of flat portions 58K pass through the insertion portions 5H1 and the cylindrical portions 58A of the bearings 58 are supported in the bearing supporting portions 5H2, the first contact portions 502C1 press the bearing projecting pieces 58H. As a result, the side walls 502 of the sheet feeding holder 50 and the bearings 58 integrally rotate, whereby the circumferential positions of the pairs of flat portions 58K can be aligned with predetermined retracted positions. By aligning the pairs of flat portions 58K with the predetermined retracted positions according to the rotation of the feed unit 5, the separation of the feed unit 5 from the unit housing 5H is prevented.

Further, in this embodiment, the side walls 502 of the sheet feeding holder 50 are relatively swingable with respect to the bearings 58 while the pickup roller 112 is moving between the lower end position and the sheet feeding position. Thus, a vertical movement of the pickup roller 112 is smoothly realized.

The sheet feeding device 3 and the image forming apparatus 1 according to the embodiment of the present disclosure are described above. According to such configurations, the regulation of the swing of the sheet feeding holder 50 by the pressing force applied to the sheet feed roller 113 is suppressed. As a result, the pickup roller 112 is stably vertically moved to realize the stable feed of the sheet P. Further, an image can be stably formed on the sheet P.

Figure 8:
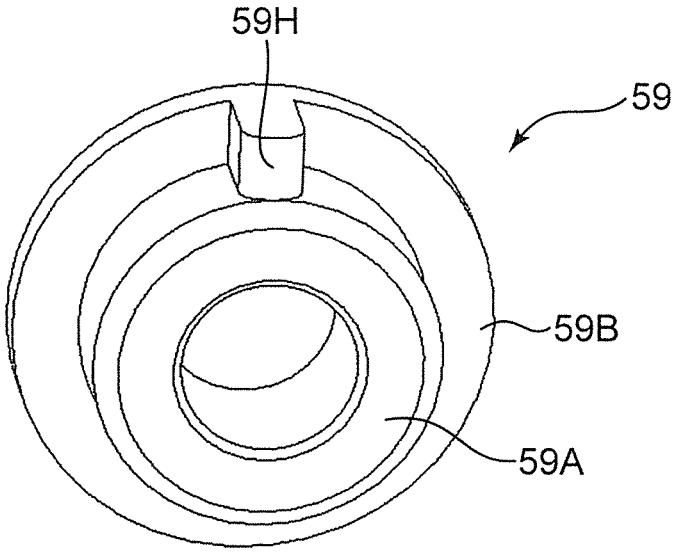
FIG. 8 is a perspective view of a part of a bearing according a modification of the present disclosure.

Note that although the feed unit 5 includes the bearings 58 in the above embodiment, the present disclosure is not limited to this. FIG. 8 is a perspective view of an inner bearing portion 59 according to a modification of the present disclosure. In this modification, the inner bearing portion 59 is mounted into the bearing 58 of the feed unit 5 according to the above embodiment. The inner bearing portion 59 has substantially the same shape as the appearance shape of the bearing 58 and fitted into the bearing 58. The inner bearing portion 59 is formed of a material with higher slidability than the bearing 58. The inner bearing portion 59 includes an inner cylindrical portion 59A, an inner flange portion 59B and an inner projection portion 59H. The inner cylindrical portion 59A is inserted into the cylindrical portion 58A of the bearing 58. Further, the inner flange portion 59B is arranged to overlap the flange portion 59B. The inner projection portion 59H is a projection projecting from an outer peripheral part of the inner cylindrical portion 59A and in contact with the inner flange portion 59B. When the inner cylindrical portion 59A is inserted into the cylindrical portion 58A, the inner projection portion 59H is engaged with an unillustrated recess formed in the bearing projecting piece 58H. As a result, the inner bearing portion 59 and the bearing 58 are integrated. By pivotally supporting the sheet feed roller shaft 51 (FIG. 3) in the cylindrical interior of the inner cylindrical portion 59A with high slidability, the rotation of the sheet feed roller shaft 51 is stably maintained.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding device, comprising:

a sheet feeding unit including a housing having a pair of wall portions; and a feed unit detachably attachable to the housing and including a pickup roller configured to feed a sheet and a sheet feed roller configured to further convey the sheet fed by the pickup roller;

wherein:

the feed unit includes:

a holder having a pair of side walls each having a bearing hole portion open on one end side thereon in a sheet conveying direction;

a shaft extending between the pair of side walls and serving as a rotary shaft of the sheet feed roller; and a pair of bearing portions mounted in the bearing hole portions to project outwardly in an axial direction of the shaft from the side walls and configured to rotatably support the shaft;

the housing includes a pair of shaft supporting portions provided on the pair of wall portions and capable of supporting outer peripheral parts of the bearing portions projecting from the side walls; and when the feed unit is attached to the housing, the pair of bearing portions are supported in the pair of shaft supporting portions and the holder swings with the outer peripheral parts of the bearing portions as a swing axis, whereby the pickup roller is vertically movable.

2. A sheet feeding device according to claim 1, wherein:

the bearing portion includes a cylindrical portion and a flange portion provided on an end part of the cylindrical portion in the axial direction; and the flange portion comes into contact with an inner side surface of the side wall in the axial direction and the cylindrical portion is inserted into the bearing hole portion, whereby the bearing portion is supported on the side wall of the holder.

3. A sheet feeding device according to claim 2, wherein:
the bearing portion includes:
a pair of D-cut portions each having a flat surface formed by partly cutting the outer peripheral part of the cylindrical portion; and
a projection portion projecting from one of the flat surfaces of the pair of D-cut portions;
the shaft supporting portion of the housing includes:
a shaft hole portion configured such that the cylindrical portion of the bearing portion projecting from the side wall is inserted thereinto and having an inner diameter capable of pivotally supporting the cylindrical portion; and
an insertion portion cut to communicate from an end edge of the corresponding one of the pair of wall portions of the housing to the shaft hole portion, the insertion portion being defined by a pair of facing surfaces and a distance between the pair of facing surfaces being set to be longer than a width between the flat surfaces of the pair of D-cut portions of the cylindrical portion of the bearing portion and shorter than an outer diameter of the cylindrical portion; and
the pickup roller is arranged at an initial position to be able to come into contact with the upper surface of the sheet when the holder is rotated about the bearing portions after the cylindrical portions of the bearing portions pass through the insertion portions with the flat surfaces of the pairs of D-cut portions facing the pairs of the facing surfaces and the bearing portions are rotatably supported in the shaft hole portions.

4. A sheet feeding device according to claim 3, wherein:
the side wall of the holder includes a guide hole bulging outwardly from a peripheral edge of the bearing hole portion, open to communicate with the bearing hole portion and have a predetermined circumferential length along a circumferential direction in the rotation, and engageable with the projection portion of the bearing portion inside;
while each inner wall portion of the side wall defining upstream side of the guide hole in the rotating direction comes into contact with the projection portion, the bearing portions rotate and, when the pickup roller reaches the initial position, the flat surfaces of the D-cut portions are arranged at positions to intersect with the facing surfaces of the insertion portions in arranging the pickup roller at the initial position by rotating the holder about the bearing portions after the bearing portions are mounted in the shaft supporting portions of the housing.

5. A sheet feeding device according to claim 4, further comprising:
a sheet storage portion configured to store the sheets; and
a lift plate arranged in the sheet storage portion, being stacked with the sheets thereon and vertically movable;
wherein:
the pickup roller is arranged above downstream end parts of the sheets stored in the sheet storage portion in a conveying direction at the initial position when the feed unit is attached to the housing;
the pickup roller is vertically movable between the initial position and a sheet feeding position located above the initial position for feeding the sheet according to the swing of the holder about the bearing portions by being pushed up by the lift plate;
the projection portions of the bearing portions are arranged in the guide holes and not in contact with the inner wall portions during a movement of the pickup roller between the initial position and the sheet feeding position.

6. An image forming apparatus, comprising:
a sheet feeding device according to claim 1; and
an image forming unit configured to form an image on the sheet fed by the sheet feeding device.

* * * * *